US010734743B2

(12) United States Patent
Logan, Jr. et al.

(10) Patent No.: US 10,734,743 B2
(45) **Date of Patent: *Aug. 4, 2020**

(54) ADVANCED PANEL MOUNT CONNECTOR AND METHOD

(71) Applicant: Glenair, Inc., Glendale, CA (US)

(72) Inventors: Ronald T. Logan, Jr., Pasadena, CA (US); Sean Zargari, Los Angeles, CA (US); Mehrdad Ghara, Aliso Viejo, CA (US); Huan Do, Westminster, CA (US)

(73) Assignee: Glenair, Inc., Glendale, CA (US)

( * ) Notice: Subject to any disclaimer, the term of this patent is extended or adjusted under 35 U.S.C. 154(b) by 346 days.

This patent is subject to a terminal disclaimer.

(21) Appl. No.: 15/799,224

(22) Filed: Oct. 31, 2017

(65) Prior Publication Data

US 2018/0054014 A1 Feb. 22, 2018

Related U.S. Application Data

(63) Continuation of application No. 14/091,254, filed on Nov. 26, 2013, now Pat. No. 9,819,107.

(51) Int. Cl.

| | |
|---|---|
| ***H01R 12/91*** | (2011.01) |
| ***H01R 12/58*** | (2011.01) |
| ***H01R 12/71*** | (2011.01) |
| ***H01R 13/74*** | (2006.01) |

(52) U.S. Cl.

CPC ..... *H01R 12/91* (2013.01); *H01R 12/585* (2013.01); *H01R 12/712* (2013.01); *H01R 13/746* (2013.01); *Y10T 29/49147* (2015.01)

(58) Field of Classification Search

CPC .. H01R 12/523; H01R 12/585; H01R 9/0735; H01R 9/0515; H01R 33/205; G02B 6/4236; G02B 6/4245; Y10T 29/49147

USPC ..... 439/544–546, 550, 551, 11, 246–248, 439/562–565, 569, 571–573, 65, 78; 385/14

See application file for complete search history.

(56) References Cited

U.S. PATENT DOCUMENTS

| | | | |
|---|---|---|---|
| 4,457,574 | A | 7/1984 | Walters |
| 4,664,467 | A | 5/1987 | Tengler et al. |
| 4,666,228 | A | 5/1987 | Wood |

(Continued)

FOREIGN PATENT DOCUMENTS

| | | |
|---|---|---|
| EP | 1696252 B1 | 8/2011 |

OTHER PUBLICATIONS

Radiall; Data Bus Contact Solutions; Mar. 2002; Radiall.

(Continued)

*Primary Examiner* — Amy Cohen Johnson
*Assistant Examiner* — Paul D Baillargeon
(74) *Attorney, Agent, or Firm* — Pritzkau Patent Group LLC

(57) ABSTRACT

A panel mount connector and method involve a connector shell assembly that is configured to be received in an opening that is defined by a panel with the connector shell defining a through passage. A flexible circuit board is supported within the through passage and defines a first external connection interface at one end for external electrical access from one side of the panel when the connector shell assembly is installed in the panel and at least the first external connection interface is supported for independent movement relative to the connector shell.

14 Claims, 7 Drawing Sheets

(56) References Cited

U.S. PATENT DOCUMENTS

| | | | | |
|---|---|---|---|---|
| 4,690,492 | A | 9/1987 | Beard | |
| 4,798,441 | A | 1/1989 | Clark | |
| 5,448,676 | A | 9/1995 | White et al. | |
| 5,596,665 | A | 1/1997 | Kurashima et al. | |
| 5,930,428 | A | 7/1999 | Irwin et al. | |
| 6,004,044 | A | 12/1999 | Paulus et al. | |
| 6,043,432 | A | 3/2000 | Gretz | |
| 6,702,480 | B1 | 3/2004 | Sparacino | |
| 6,873,800 | B1 | 3/2005 | Wei et al. | |
| 6,910,812 | B2 | 6/2005 | Pommer et al. | |
| 7,008,119 | B2 | 3/2006 | Mizue et al. | |
| 7,093,985 | B2 | 8/2006 | Lord et al. | |
| 7,160,039 | B2 | 1/2007 | Hargis et al. | |
| 7,255,583 | B2 * | 8/2007 | Takagi | H01R 13/6315 439/248 |
| 7,278,791 | B2 | 10/2007 | Demaret et al. | |
| 7,439,449 | B1 | 10/2008 | Kumar et al. | |
| 7,463,830 | B2 | 12/2008 | Whitehead | |
| 7,543,997 | B1 | 6/2009 | McColloch | |
| 7,690,849 | B2 | 4/2010 | Scharf et al. | |
| 8,133,074 | B1 | 3/2012 | Park et al. | |
| 8,187,032 | B1 | 5/2012 | Park et al. | |
| 8,708,575 | B2 | 4/2014 | Hung et al. | |
| 9,081,156 | B2 | 7/2015 | Togami | |
| 9,297,972 | B2 | 3/2016 | Logan, Jr. et al. | |
| 9,819,107 | B2 | 11/2017 | Logan, Jr. et al. | |
| 2003/0026556 | A1 | 2/2003 | Mazotti et al. | |
| 2003/0053767 | A1 | 3/2003 | Cheng et al. | |
| 2003/0118293 | A1 | 6/2003 | Canace et al. | |
| 2003/0156802 | A1 | 8/2003 | Togami | |
| 2003/0201462 | A1 | 10/2003 | Pommer et al. | |
| 2004/0208459 | A1 | 10/2004 | Mizue et al. | |
| 2005/0018978 | A1 | 1/2005 | Nevo et al. | |
| 2005/0045374 | A1 | 3/2005 | Kumar et al. | |
| 2005/0174748 | A1 | 8/2005 | Kojima | |
| 2005/0175299 | A1 | 8/2005 | Hargis et al. | |
| 2005/0281514 | A1 | 12/2005 | Oki et al. | |
| 2006/0002400 | A1 | 1/2006 | Kenyon et al. | |
| 2006/0024005 | A1 | 2/2006 | Ice et al. | |
| 2006/0083517 | A1 | 4/2006 | Saito et al. | |
| 2006/0115206 | A1 | 6/2006 | Supper | |
| 2006/0257081 | A1 | 11/2006 | Ishigami | |
| 2007/0003195 | A1 | 1/2007 | Ice et al. | |
| 2007/0019964 | A1 | 1/2007 | Whitehead et al. | |
| 2008/0285923 | A1 | 11/2008 | Scharf et al. | |
| 2012/0266434 | A1 | 10/2012 | Yu | |
| 2013/0109228 | A1 | 5/2013 | Sykes et al. | |
| 2013/0121648 | A1 | 5/2013 | Hung et al. | |
| 2013/0279862 | A1 | 10/2013 | Ishii et al. | |
| 2013/0294732 | A1 | 11/2013 | Li et al. | |
| 2013/0322830 | A1 | 12/2013 | Tan et al. | |
| 2014/0029900 | A1 | 1/2014 | Logan, Jr. et al. | |
| 2015/0147911 | A1 | 5/2015 | Logan, Jr. et al. | |
| 2018/0203196 | A1 | 7/2018 | Logan, Jr. et al. | |
| 2019/0361182 | A1 * | 11/2019 | Logan | G02B 6/4245 |

OTHER PUBLICATIONS

Protokraft; Magnum Series Optical Receiver Unit; Apr. 16, 2010; Protokraft; Kingsport, TN.

Protokraft; Magnum Series Optical Transmitter Unit; Apr. 16, 2010; Protokraft; Kingsport, TN.

The International Search Report and the Written Opinion of the International Searching Authority for International Application No. PCT/US2013/052409 which is associated with U.S. Appl. No. 13/562,267, dated Nov. 26, 2013, Daejeon Metropolitan City, Republic of Korea.

Amendments and Arguments Under PCT Article 34 for International Application No. PCT/US2013/052409 which is associated with U.S. Appl. No. 13/562,267, dated May 29, 2014, Los Angeles, CA.

International Preliminary Report on Patentability for International Application No. PCT/US2013/052409 which is associated with U.S. Appl. No. 13/562,267, dated Nov. 18, 2014, Daejeon Metropolitan City, Republic of Korea.

First Examination Office Action for European Patent Application No. 14865898.2 dated May 3, 2019 which is related to PCT Application No. PCT/US2014/066653 filed on Nov. 20, 2014 which is related to U.S. Appl. No. 14/091,254, filed Nov. 26, 2013.

Prosecution history of U.S. Appl. No. 15/920,138 as of Sep. 5, 2019.

Prosecution history of U.S Appl. No. 16/537,603 as of Jan. 15, 2020.

* cited by examiner

ADVANCED PANEL MOUNT CONNECTOR AND METHOD

RELATED APPLICATION

This application is a continuation application of copending U.S. patent application Ser. No. 14/091,254 filed on Nov. 26, 2013, the disclosure of which is incorporated herein by reference.

BACKGROUND

The present invention is generally related to the field of panel mount connectors and, more particularly, to an advanced panel mount connector configured for independent movement of an external connection interface relative to a connector shell, as well as an associated method.

Panel or chassis mount connectors are used in diverse applications such as, for example, military and avionics applications. Often, modules are used to serve some predetermined function or functions such that a failed module can readily be replaced in the field. One or more panel mount connectors can help simplify such a module exchange. Panel mount connectors typically include a connector shell having a mating portion that is configured for engaging a complementary connector and a rear portion that often supports an array of outwardly extending electrical pins. The mating portion can be configured with an external thread for receiving a jam nut for purposes of securing the connector in place on a panel. The mating portion can also be configured with a peripheral outline to be received in a mounting hole of a particular shape that is defined by the panel. For example, a D-shaped mounting hole can be used, which is intended to limit rotation of the connector shell both during installation and subsequent thereto. Such an installation may be referred to hereinafter as a rotational indexing installation. A flange can form part of the connector shell between the mating and rear portions. Thus, the connector can capture the panel between the jam nut and the flange when the connector is ultimately installed in the panel. Another type of panel mount connector can include a mounting flange or flanges provided with holes through which fasteners can be used to secure the connector to a panel. The latter may be referred to hereinafter as a flange panel mount connector.

The manufacturing process for a module supporting one or more panel mount connectors can proceed by initially soldering the electrical pins of the connectors to a printed circuit board that is to be mounted internal to the module. For example, the printed circuit board can serve as a backplane for the module through which all external communication can take place. After soldering the panel mount connectors to the printed circuit board, the mating portions of the connectors can be positioned through a set of cooperating mounting openings from the rear or internal side of a module panel. A jam nut can be installed on the mating portion of each connector from the front, opposite side of the module panel and torqued to specification. Of course, a flange panel mount connector can be secured using fasteners such as, for example, screws to secure the connector to the panel. Unfortunately, this installation procedure can be problematic at least for the reasons discussed immediately hereinafter.

In traditional panel mount connector designs, movement of the connector shell produces a corresponding movement of the pins. Once the pins of the connectors have been soldered to the printed circuit board, however, such movement of the connector shell becomes problematic since the pins are independently fixed in position by the printed circuit board, which may be separately mounted to the panel or to other internal structures of the equipment chassis. This movement, therefore, can subject the pins and the printed circuit board to significant mechanical force, resulting in damage to the pins or the solder joints, or both. The force can be generated, for example, by torqueing of the jam nut during installation, despite the presence of an installation configuration such as a D-hole that may be intended to reduce such forces. In this regard and with respect to a rotational indexing installation, it should be appreciated that the mating portion of a panel mount connector is generally received in the panel mounting opening subject to a tolerance which can nevertheless allow at least some limited range of rotation of the panel mount connector relative to the panel itself. Applicants recognize that even this limited rotation can be problematic with respect to damaging the pins, solder joints, and/or printed circuit board. Moreover, problematic forces can also be generated during field use, for example, by over tightening a mating connector. As will be further described immediately hereinafter, the prior art includes a number of different approaches which attempt to address this concern.

One approach that has been taken by the prior art resides in the use of a tool that is used to hold the connector in a manner that is intended to resist rotation of the connector during torqueing of the jam nut. Unfortunately, the success of this approach is based on the skill of the installation technician. Another approach is described by U.S. Pat. Nos. 8,133,074 and 8,187,032 (hereinafter, the '074 and '032 patents, respectively). In this approach, an external frame is utilized to transfer rotational torque away from the connector. Unfortunately, the frame is relatively bulky and necessitates a relatively complex installation procedure.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, embodiments, systems and methods are described in relation to a panel mount connector. A connector shell assembly is configured to be received in an opening that is defined by a panel, the connector shell defining a through passage. A flexible circuit board is supported substantially within the through passage and defines a first external connection interface at one end thereof for external electrical access from one side of the panel when the connector shell assembly is installed therein and defines a second external connection interface at an opposing end of the flexible circuit board for external access from an opposite side of the panel when the connector shell assembly is installed therein with the second external connection interface including at least one of an electrical connection interface for external electrical communication on the opposing side of the panel and an optical connection interface for external optical communication on the opposing side of the panel and at least the first external connection interface is supported for independent movement relative to the connector shell.

BRIEF DESCRIPTIONS OF THE DRAWINGS

Exemplary embodiments are illustrated in referenced figures of the drawings. It is intended that the embodiments and figures disclosed herein are to be illustrative rather than limiting.

Figure 6A:
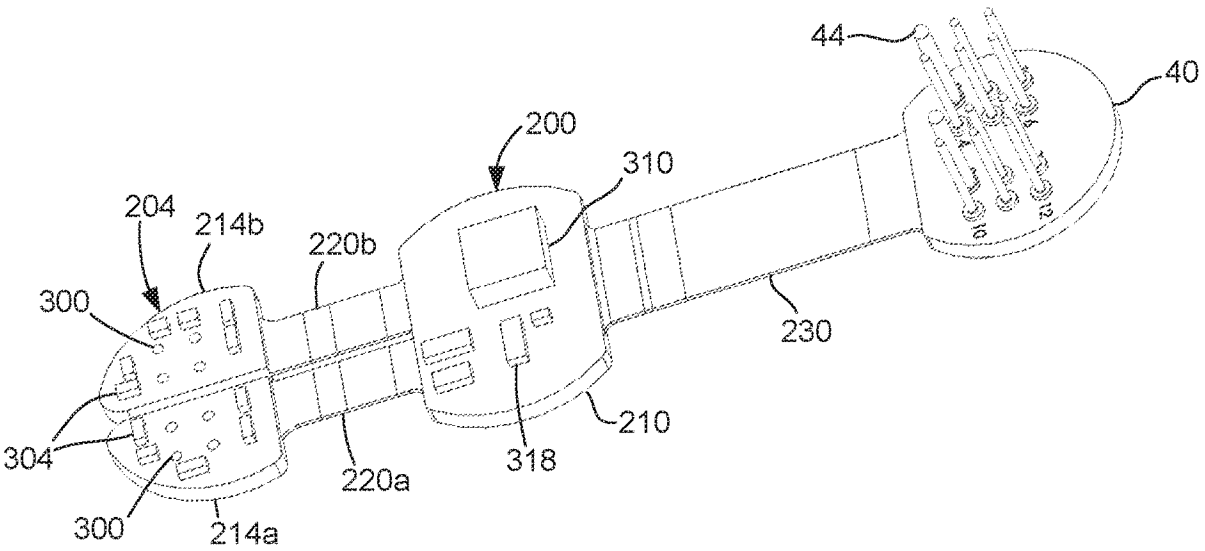

FIG. 6*a* is a diagrammatic top view, in perspective, illustrating details with respect to an embodiment a flexible circuit board assembly in a flat or unfolded view.

Figure 6B:
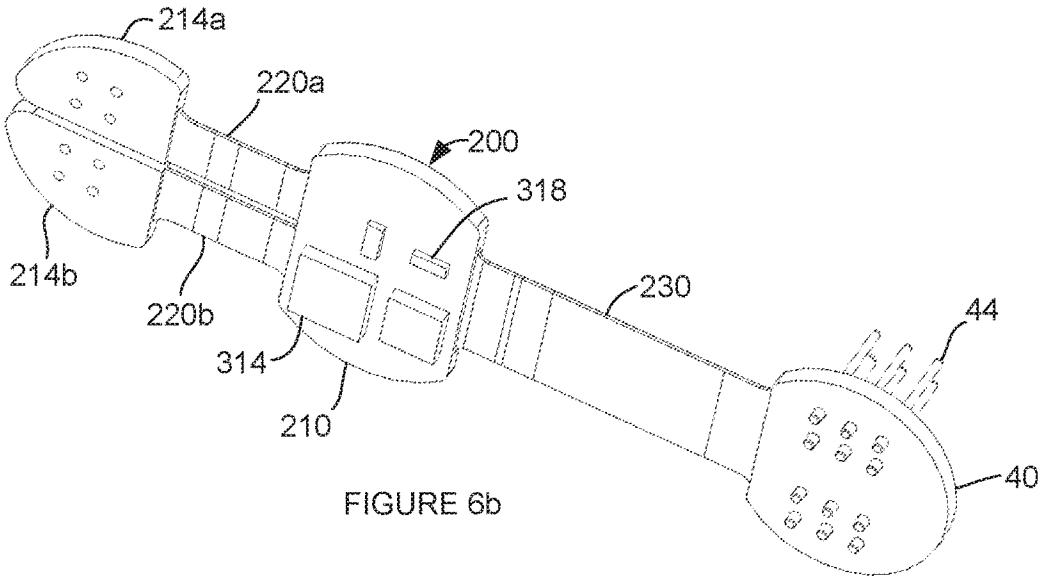

FIG. 6*b* is a diagrammatic bottom view, in perspective, illustrating details with respect to the embodiment a flexible circuit board assembly of FIG. 6 in a flat or unfolded view.

Figure 7:
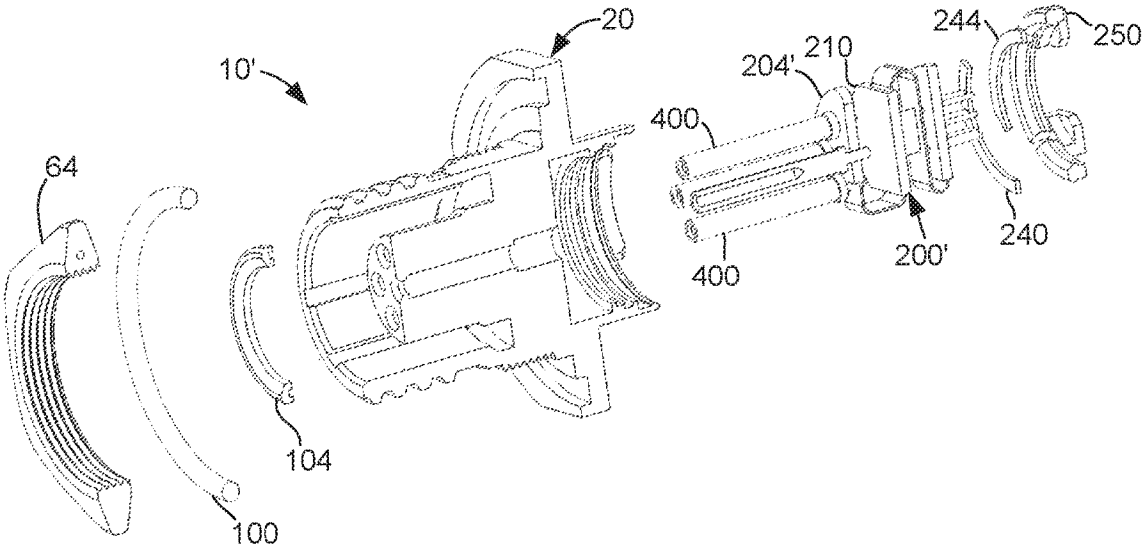

FIG. 7 is a diagrammatic partially cut-away exploded view, in perspective, of another embodiment of a connector in accordance with the present disclosure.

Figure 8:
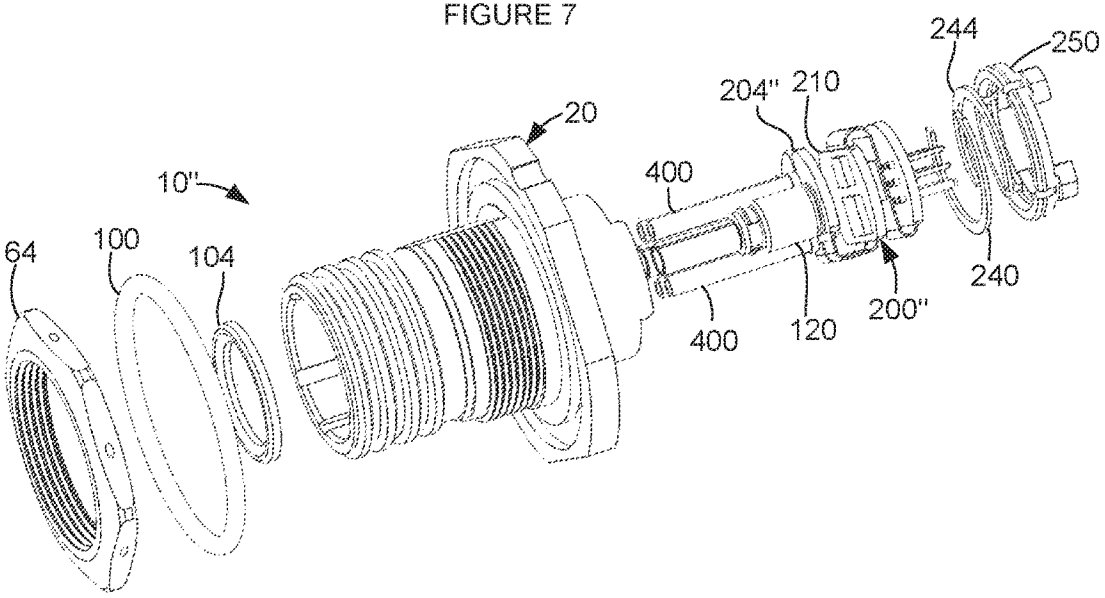

FIG. 8 is a diagrammatic partially exploded view, in perspective, of yet another embodiment of a connector in accordance with the present disclosure.

Figure 9:
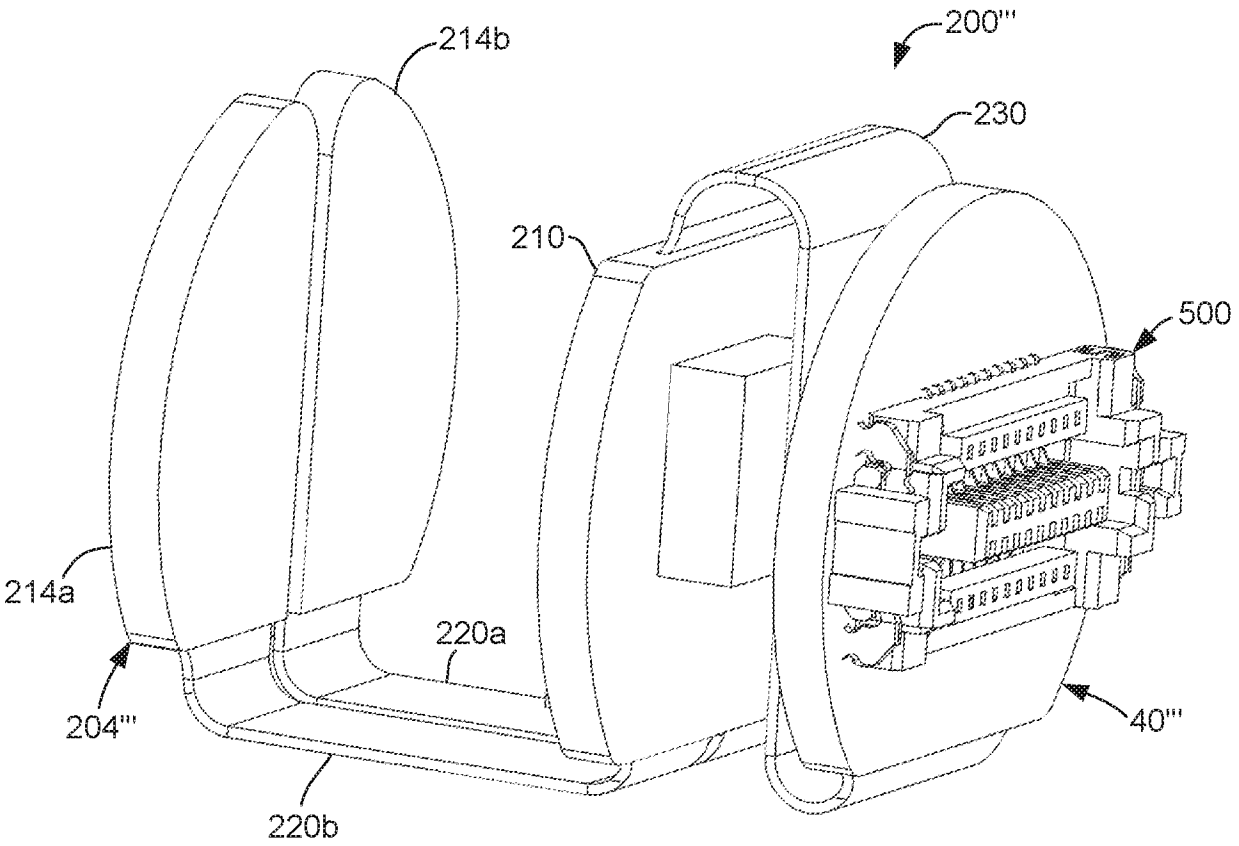

FIG. 9 is a diagrammatic partially exploded view, in perspective, of another embodiment of a flexible circuit board which supports a high speed multi-contact electrical connector in accordance with the present disclosure.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents, as defined within the scope of the appended claims. It is noted that the drawings are not to scale and are diagrammatic in nature in a way that is thought to best illustrate features of interest. Descriptive terminology may be used with respect to these descriptions, however, this terminology has been adopted with the intent of facilitating the reader's understanding and is not intended as being limiting. Further, the figures are not to scale for purposes of illustrative clarity.

Figure 1:
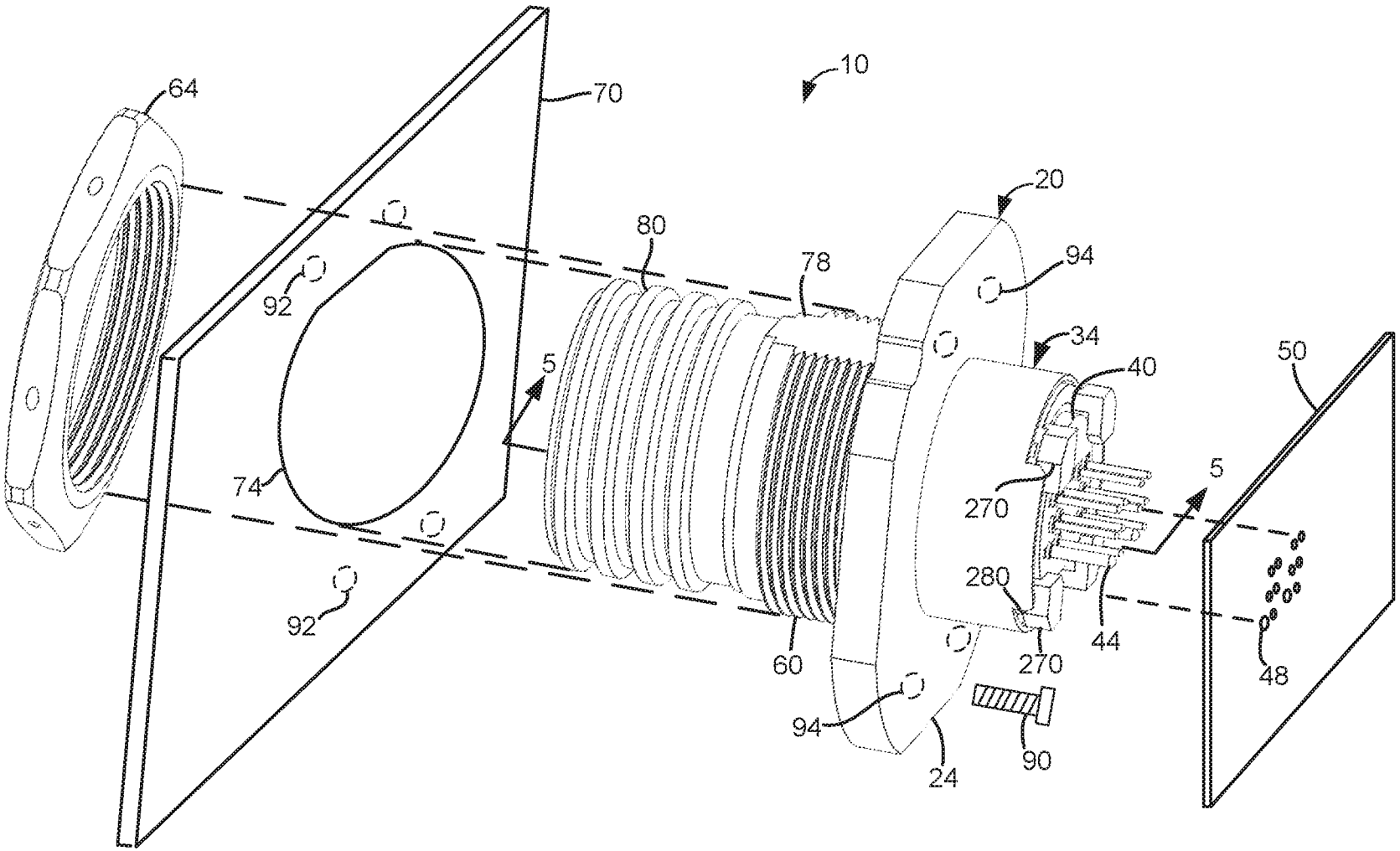
FIG. 1 is a diagrammatic partially exploded view, in perspective, illustrating a panel mount connector according to the present disclosure.

Turning now to the figures wherein like components may be designated by like reference numbers throughout the various figures, attention is immediately directed to FIG. 1 which is a diagrammatic partially exploded view, in perspective, illustrating an embodiment of a panel mount connector according to the present disclosure and generally indicated by the reference numeral 10. Connector 10 includes a connector shell 20 having a flange 24. The connector shell can be formed from any suitable material such as, for example, aluminum, stainless-steel, or plastic composite. A mating portion 30 of the connector can be positioned on one side of the flange while a rear portion 34 can be positioned on an opposite side of the flange. Rear portion 34 can support a first external connection interface 40 for externally electrically interfacing the connector. In the present embodiment, an array of electrical connector pins 44 extends outwardly from an entrance opening of rear portion 34. In the present embodiment, interface 40 includes one or more rigid substrates that can be provided in a manner that that is yet to be described. The array of pins can be received in a complementary pattern of holes 48 that is defined by a printed circuit board 50. The latter is diagrammatically, partially shown and is understood to include conductive traces for purposes of establishing electrical communication, for example, with components that are housed by a module. As will be further described, any suitable arrangement of pins with respect to number, positioning and diameter can be used without limitation and is not limited to the specific pattern that is shown. It should be appreciated that printed circuit board 50 is generally supported independent of its electrical interface to connector 10. For example, the printed circuit board can be supported within a module and can serve as a backplane for interfacing the module to the outside world. While only one complementary hole pattern 48 is shown on the printed circuit board, the latter can be configured with hole patterns for any suitable number of connectors such that the printed circuit board interfaces with a plurality of connectors. The connectors can be of the same type, however, this is not a requirement. Generally, connectors can be installed on the printed circuit board to form a sub-assembly prior to installing this subassembly into a module. Since pins 44 are typically soldered to printed circuit board 50, care should be exercised with respect to inducing relative movement between the connectors and printed circuit board, at least during installation, since the solder connections themselves can be relatively fragile. Excessive force can result in damaging the printed circuit board and/or the connector pins. Applicants recognize that this is especially true as connector designs move to ever-smaller-diameter pins to enhance the number of connections the connector can support in a given amount of panel space, or to permit the passage of high-frequency/high-data-rate signals. Applicants further recognize that pin array 44 can be comprised of a combination of at least one of straight pins, twinax, coax, quadrax or parallel array contacts, or any other type of electrical contacts, suitable for carrying a variety of signal types. The electrical contacts can be attached to printed circuit board 50 using solder, or can cooperatively engage a mating contact receptacle, either singly, or as an array of contacts.

With continuing reference to FIG. 1, a panel 70 is diagrammatically shown and defines an opening 74 that is configured for receiving the mating portion of the connector. Panel 70, for example, can form one face of a module with printed circuit board 50 supported directly therebehind. While this form of connector installation is widely used, any suitable form of installation is considered to be within the scope of the present disclosure so long as the teachings that have been brought to light herein have been applied. As a further detail with respect to FIG. 1, the connector and opening can be configured to cooperate in a rotational indexing installation. By way of non-limiting example, opening 74 can be configured as having a D-shape, while the connector is configured with a cooperating shape having a flat 78 on one side. Any suitable shape can be utilized for purposes of providing an indexed installation. Mating portion 30 of the connector can include a threaded base 60 that is externally threaded to receive a jam nut 64. During installation, mating portion 30 is positioned through opening 74 for receiving jam nut 64. The jam nut can then be torqued to specification such that panel 70 is captured between the jam nut and flange 24 to fix connector 10 in position on the panel. As discussed above, the mating portion of the connector is received within opening 74 subject to a tolerance which permits at least limited rotation of the connector relative to the panel during torqueing of the jam nut as well as during other post-installation events. In some cases, even this limited rotation can at least result in damage to the electrical connections such as, for example, solder connections between printed circuit board 50 and pins 44.

After installing connector 10 to panel 70, mating portion 30 of the connector can engage a complementary connector (not shown). In the present embodiment, connector 10 is illustrated as having a barrel 80, forming the mating portion, that is threaded for purposes of engaging the complementary connector, although any suitable configuration can be utilized including, but not limited to threaded engagement, bayonet mount, multiple-start threads, push-pull interfaces and the like. Barrel 80 can support any suitable arrangement for purposes of establishing external communications through connector 10 using electrical connections, optical connections or any suitable combination thereof, as will be further described at appropriate points hereinafter.

Still referring to FIG. 1, in another embodiment connector 10 can be installed on panel 70 using fasteners 90, one of which is illustrated, of any suitable type such as, for example, threaded fasteners. In this embodiment, apertures 92, shown in phantom using dashed lines, can be defined by panel 70 and can carry an internal thread. Fasteners can be installed through openings 94 defined by flange 24 and shown in phantom using dashed lines. It should be appreciated that flat 78 and a cooperating shape of opening 74 are not required in this embodiment since the fasteners can serve as a rotational indexing feature. The teachings that have been brought to light herein are equally applicable to the present embodiment since connector 10 can be subject to post-installation torque, for example, when a mating connector is installed or removed.

Figure 2:
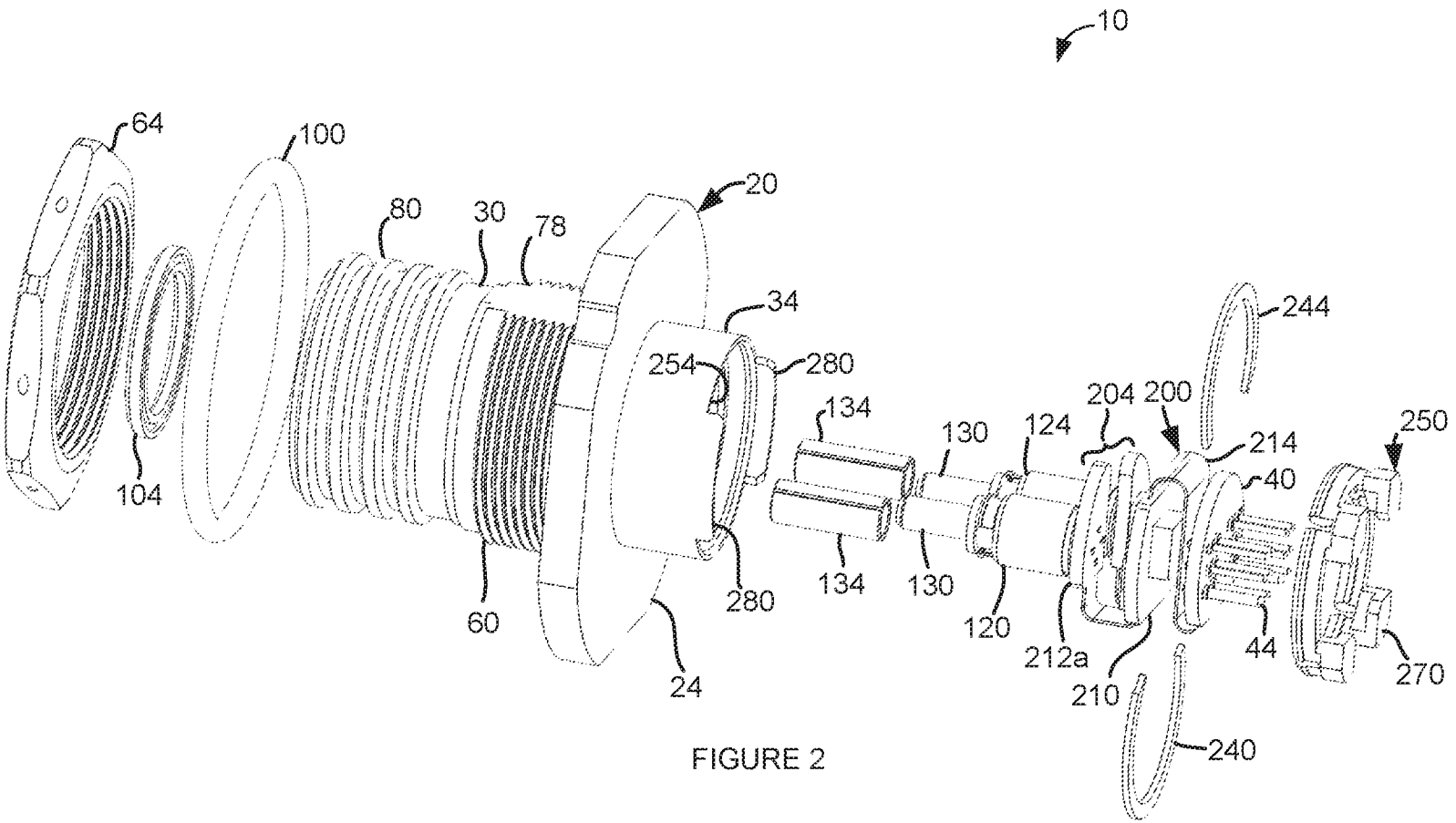
FIG. 2, is a diagrammatic exploded view, in perspective, illustrating further details of the structure of the embodiment of the connector of FIG. 1.

Attention is now directed to FIG. 2 in conjunction with FIG. 1. The former is a diagrammatic exploded view, in perspective, illustrating further details of the structure of the present embodiment of connector 10. At barrel end 80, a seal 100 is receivable against flange 24 and can be seated in an annular groove that is not visible in the present view. Seal 100 can be captured between panel 70 and the flange when the connector is installed in order to accomplish a water tight seal. A seal 104 can be received within barrel 80 for internal sealing engagement between an internal surface of the barrel and the complementary connector, for example, to achieve a water tight seal. In the present embodiment, shell 20 is configured for supporting an opto-electronic interface that includes a transmitter optical subassembly (TOSA) 120 and a receiver optical subassembly (ROSA) 124. Each of these subassemblies can include a ferrule 130 that is configured to slidingly receive a split sleeve 134. Generally, the split sleeve can be formed from a ceramic material. In the instance of a TOSA, the subassembly can include, for example, a laser diode and associated drive electronics while, in the instance of a ROSA, the subassembly can include, for example, a photodiode and associated electronics. Suitable embodiments of an advanced form of each are described, for example, in U.S. patent application Ser. No. 13/562,267, U.S. Published Patent Application no. 2014/0029900, now U.S. Pat. No. 9,297,972, which is commonly owned with the present application and hereby incorporated herein by reference.

Figure 3:
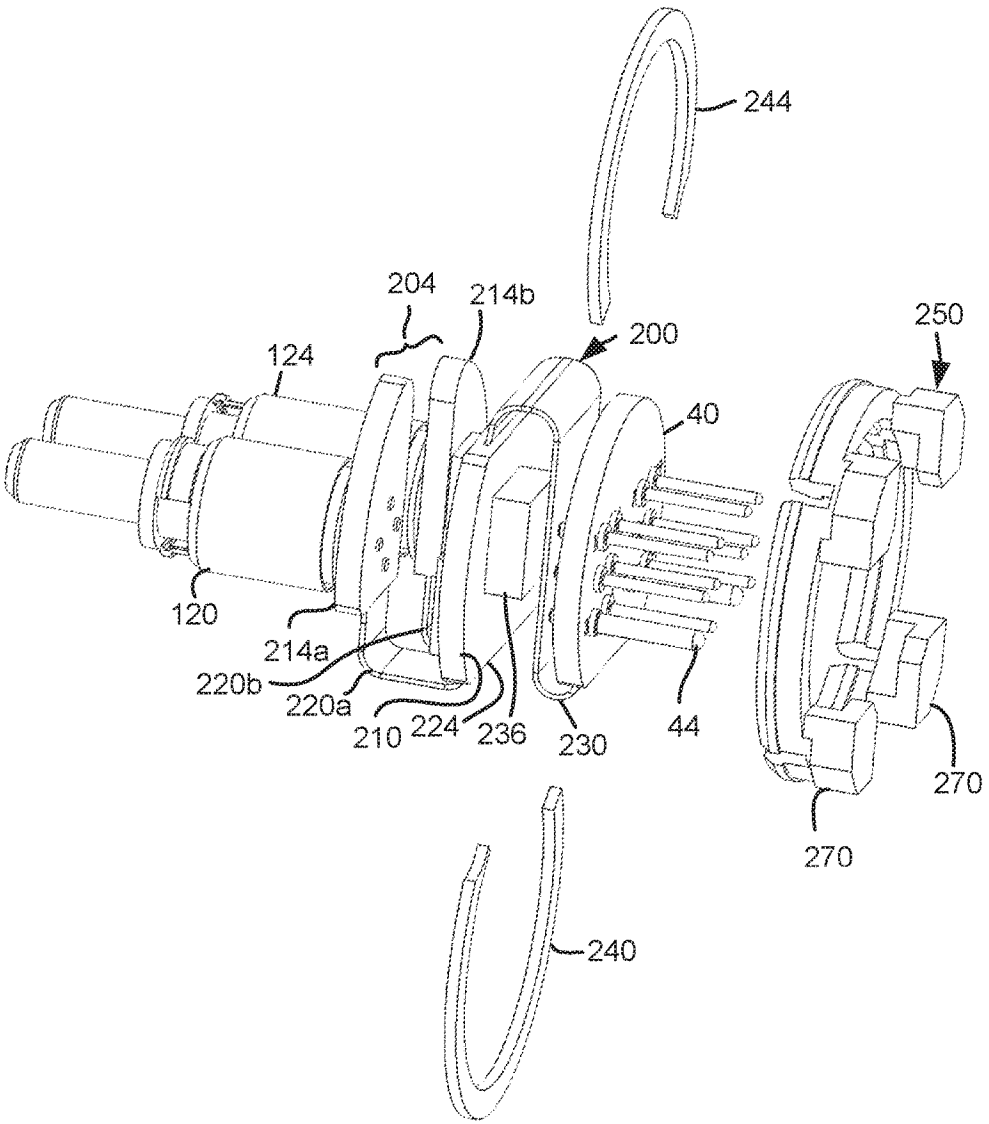
FIG. 3 is a further enlarged perspective view illustrating details with respect to an embodiment of a flexible circuit board assembly of FIGS. 1 and 2 as well as associated components.

Referring to FIG. 3 in conjunction with FIG. 2, the former is a further enlarged perspective view illustrating details with respect to an embodiment of a flexible circuit board assembly, indicated by the reference number 200, and associated components. As illustrated by the exploded view of FIG. 2, the flexible circuit board assembly, TOSA, ROSA and associated components are receivable within the through passage or barrel of connector shell 20. TOSA 120 and ROSA 124 are electrically interfaced at a second external connection interface 204. In the present embodiment, first external connection interface 40 and second external connection interface 200 form opposing ends of flexible circuit board assembly 200 which also includes a middle circuit section 210. In an embodiment, each of the first and second external connection interfaces and the middle circuit section can include rigid substrates, as needed, that are bonded to an overall flexible printed circuit board which can extend the full length of the assembly. Second external connection interface 204 includes electrical connection pads 214*a* and 214*b* in electrical communication with the TOSA and ROSA, respectively. By way of example, these electrical connections can be solder connections. A TOSA flexible circuit extension 220*a* extends from a side margin 224 of middle circuit section 210 to connection pad 214*a* while a ROSA flexible circuit extension 220*b* extends from side margin 224 to connection pad 214*b*. Extensions 220*a* and 220*b* can extend to a nearest side margin of each of connection pads 214*a* and 214*b*, respectively, such that each extension defines at least approximately 180 degrees of bending. A serpentine flexible extension 230 can extend from an opposing side margin of the middle circuit section to a side margin of first external connection interface 40 such that the serpentine extension defines at least approximately 360 total degrees of bending. For reasons that will become evident, it should be appreciated that the serpentine flexible extension, in and by itself, can provide for significant relative movement of first external connection interface 40 relative to connector shell 20. Even more movement capability is provided in cooperation with extensions 220*a* and 220*b*. Any generally rigid portion of the flexible circuit board assembly such as, for example, middle circuit section 210 can support any suitable arrangement of passive and/or active components. For instance, middle circuit section 210 supports a plurality of integrated circuits and/or electronic circuit components, indicated as 236. As will be further described, a first C-clip 240 can be used to retain middle circuit section 210 within the connector shell while a second C-clip 244 can be used to retain first external connection interface 40 within a retainer ring 250.

Figure 5:
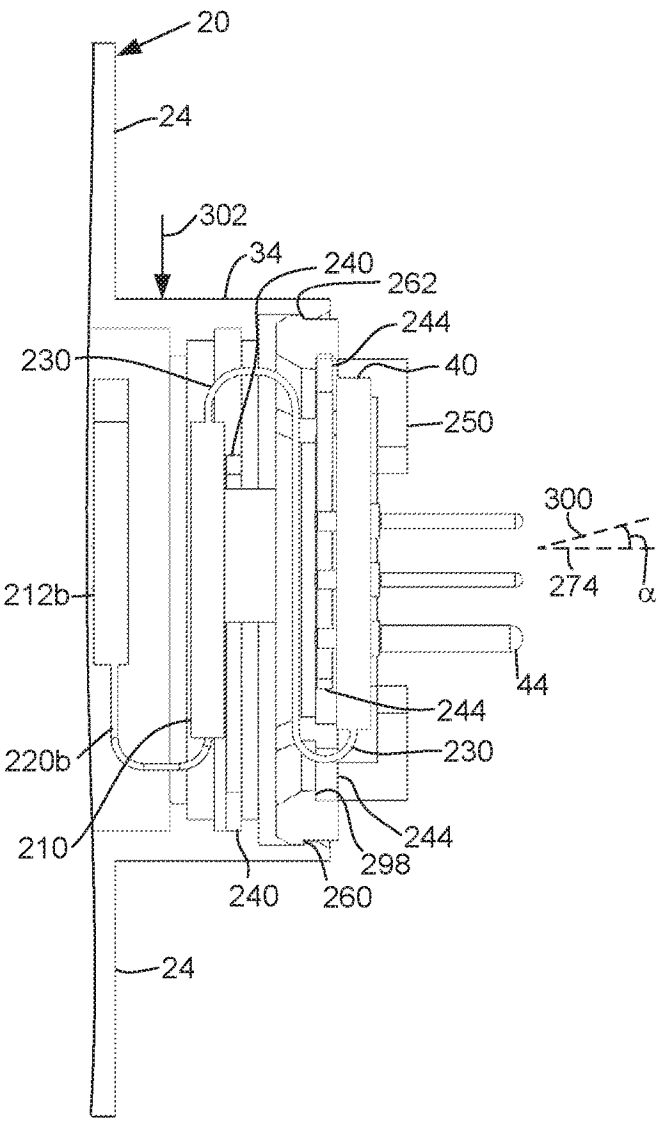
FIG. 5 is a further enlarged fragmentary partially cut-away view, in elevation, taken generally from a line 5-5 of FIG. 1, shown here to illustrate details of an embodiment of the connector of the present disclosure in an assembled condition.
Figure 4:
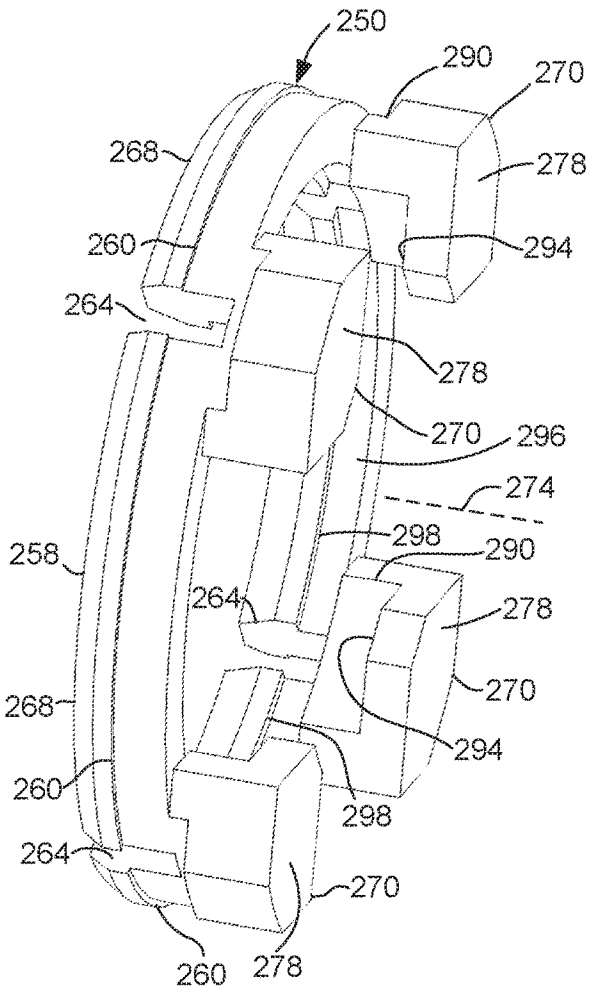
FIG. 4 is a further enlarged diagrammatic view, in perspective, illustrating further details of a retainer ring that can be used in the embodiment of the connector of FIG. 1.

Referring to FIGS. 4 and 5 in conjunction with FIGS. 1-3, FIG. 4 is a further enlarged view, in perspective of retainer ring 250 while FIG. 5 is a further enlarged fragmentary partially cut-away view, in elevation, taken generally from a line 5-5 (shown in FIG. 1), to further illustrate rear portion 34 of the connector shell, part of flange 24, flexible circuit board assembly 200 and certain related components. Retainer ring 250 is configured to be received within an entrance opening 254 (FIG. 2) of the connector shell. For this purpose, the retainer ring includes an annular snap ring portion 258 that defines an outwardly projecting annular catch 260 that is configured to resiliently engage a complementary feature 262 (FIG. 5) of the interior periphery of the connector shell. The annular snap ring portion of the retainer ring defines a plurality of notches 264, several of which are indicated, separating a plurality of resilient extensions 268 of the annular snap ring portion. The resilient extensions provide for a reduced level of engagement force with the connector shell during installation of the retainer ring while thereafter reliably maintaining an installed position. A plurality of standoff posts, each of which is indicated by the reference number 270, extend outwardly from the annular snap ring portion at least generally aligned with a central axis 274 of retainer ring 250. When the retaining ring is installed on the connector shell, it should be appreciated that a central axis of the connector shell can be coextensive with or at least be generally parallel to the central axis of the retaining ring. Each standoff post 270 can terminate in a standoff surface 278 that is defined at a free end of each post. The standoff surfaces can provide a base that can be positioned, for example, against printed circuit board 50 of FIG. 1. As seen in FIGS. 1 and 2, rear portion 34 of the connector shell can include an opposing pair of outwardly extending arcuate tabs 280. These tabs can be configured to cooperate with standoff posts 270 to serve an indexing function. That is, each actuate tab is positioned between adjacent ones of the standoff posts. It should be appreciated that although four standoff posts are shown in the present embodiment, any suitable number can be used. Retainer ring 250 can be formed from any suitable material or materials including but not limited to Ultem 1000, PPS, PEEK, and Torlon (non-glass filled). In an embodiment, the standoff posts and annular snap ring portion can be integrally formed, although this is not a requirement.

As seen in FIGS. 4 and 5, retainer ring 250 forms what may be referred to as a pocket for receiving first external connection interface 40 captured between inward facing surfaces 290 (one of which is explicitly designated) of each standoff post such that interface 40 can rotate essentially freely with respect to the retainer ring while the remainder of the flexible circuit board assembly is subject to twisting. Each standoff post further includes an inwardly projecting tab 294. Tabs 294 serve to engage an outwardly facing major surface of interface 40 to retain the interface within the retainer ring, but do not limit movement of interface 40 rotationally with respect to the retainer ring. Second C-clip 244 is received within an annular groove 296 (FIG. 4) that is defined by the retainer ring and delimited by an edge or step 298 (FIG. 5) therein. Accordingly, C-clip 244 captures interface 40 within the pocket of retainer ring 250 such that interface 40 can move left-to-right, in the view of FIG. 5, as well as tilt between C-clip 244 and tabs 294. For descriptive purposes, a direction 300 is shown which is representative of a direction that is at least generally normal to the outwardly facing major surface of interface 40 and parallel to pins 44. Direction 300 can represent tilt of interface 40 relative to the connector shell. Absent external biasing forces, direction 300 remains at least generally parallel to central axis 274 which can represent the central axis of the connector shell. While direction 300 and central axis 274 are typically aligned, a tilt angle $\alpha$ can be formed, as shown, between direction 300 and central axis 274 responsive to an external lateral force 302 that is applied to the connector shell from any direction that is transverse to the central axis of the connector shell. While tilt angle $\alpha$ and force 302 are shown in the plane of FIG. 5 due to illustrative constraints, it is to be understood that an external force (or forces) can be received from location on the peripheral outline of the connector such that angle $\alpha$ is not limited to the plane of FIG. 5. Accordingly, movement of the connector shell and retainer ring 250 relative to interface 40 encompasses relative rotation of interface 40 as well as producing a range of angular displacements characterized by tilt angle $\alpha$ between direction 300 and central axis 274 of the retainer ring. Thus, first external connection interface 40 can float or move independent of the connector shell and retainer ring 250 when pins 44 are attached to an external printed circuit board. This movement provides the ability of the connector shell to move three-dimensionally relative to interface 40 such that the interface is essentially undamaged and immune to this movement. In this regard, interface 40 can also experience, with immunity, straight line or linear translations that are at least generally aligned with central axis 274. It should be appreciated that the amounts of rotation and movement that can be accommodated are significant. With respect to rotation of connector 10 induced, for example, by installation torque, the rotation is limited only by flexible circuit assembly 200. A relative rotation of at least +/−10 degrees can readily be accommodated, which can be far greater than any installation torque-induced rotation for a typical rotational indexing installation. With respect to tilt angle $\alpha$, a range of at least +/−1.5 degrees can be provided. Linear movement on the order of 0.020" along the connector axis can also be accommodated.

Attention is now directed to FIGS. 6*a* and 6*b* which are diagrammatic views, in perspective, of flexible circuit board assembly 200 showing each of the opposing major surfaces of the assembly in a planar form for purposes of illustrating details of its structure. Second external connection interface 204 is configured to engage the electrical interfaces of TOSA 120 and ROSA 124 such as, for example, electrical interface pins using a pattern of through holes 300 each of which can be surrounded by an electrically conductive trace. In some embodiments, the second external connection interface can support electrical components 304 such as, for example, passive electrical components for purposes which include but are not limited to decoupling or impedance-matching of data transmission lines, biasing of the opto-electronic TOSA and ROSA devices and electrical tuning or filtering. Middle circuit section 210 can support active components. In the case of TOSA 120 including a light emitting element such as a laser diode, an active component can be a driver amplifier 310 (FIG. 6*a*). On the other hand, in the case of ROSA 124, having a light detector or receiver element such as a photodiode, the active component can be a limiting amplifier 314 (FIG. 6*b*). Both the driver amp and limiting amp ICs can co-exist on center section 210, or even be integrated together. The middle section 210, as seen in FIGS. 6*a* and 6*b*, can also support any suitable arrangement 318 of passive electrical components for purposes which include but are not limited to decoupling or impedance-matching of data transmission lines, biasing of opto-electronic devices, and electrical tuning or filtering. In the instance of driver amplifier 310, the electrical connection to pad 214*a* can be by way of differential drive such that at least some of the passive components can be used to terminate the differential drive arrangement in its characteristic impedance. For a laser diode that is intended to operate over a wide temperature range, at least some passive components can be directed to providing temperature compensation. First external connection interface 40 supports electrically conductive pins 44 which can be laid out in any suitable manner. In an embodiment, a selected pin, for example, can serve as a ground pin and be of an enlarged diameter or any other suitable shape/configuration relative to the other pins to serve an indexing function.

The flexible circuit assembly can include a flexible printed circuit substrate having an elongated length that can extend along the full end-to-end length of the assembly. The flexible substrate can be formed from any suitable material such as, for example, polyimide or "Kapton", and can support electrically conductive traces that are laid out in a desired pattern for purposes of forming electrical connections. In an embodiment, a sandwich construction can be applied for purposes of forming the first and second external connection interfaces and the middle circuit section. That is, the flexible substrate can be sandwiched between rigid first and second printed circuit boards arranged on opposing sides of the flexible substrate. Such rigid printed circuit boards can be can be formed from any suitable material such as, for example, FR4 and patterned with electrically conductive traces for electrical communication with cooperative electrically conductive traces defined on the flexible substrate. At first external connection interface 40, through holes, with surrounding electrically conductive traces, can be arranged to align with through holes of the flexible substrate to receive electrically conductive pins 44. The pins can initially be installed with a press/interference fit with subsequent soldering to enhance durability. Any rigid printed circuit boards that are utilized can be fixedly attached to the flexible substrate, for example, by solder and/or suitable adhesives. In another embodiment, the entire flexible circuit assembly can be comprised of a flexible substrate only, with no rigid sections, onto which active and passive components may be directly affixed. Some or all of the electrical interface pins on interface 40 can be replaced by electrical contacts optimized for high-speed electrical signal transmission, such as coax, twinax, or quadrax conductors, or one or more high-speed parallel electrical surface-mount connectors.

Installation of the flexible circuit board assembly can proceed, for example, by initially soldering the TOSA and ROSA to pads 214*a* and 214*b*, respectively. First external connection interface 40 can then be positioned within the pocket of retainer ring 250. C-clip 244 can then be installed in the retainer ring such that the gap defined by the C-clip is centered upon flex extension 230 where it departs from the side margin of interface 40. C-clip 244 is shown in an appropriate orientation with respect to interface 40 in FIG. 3. The TOSA and ROSA can then be positioned within complementary apertures that are defined by the connector shell, followed by installation of C-clip 240. The latter can be oriented such that the gap defined by the C-clip is centered upon the side margin of second external connection interface 204 from which flex extensions 220*a* and 220*b* depart. Thereafter, the flexible circuit board assembly can be folded to the form shown in FIG. 3, received within the connector shell and retainer ring 250 snapped into position onto the connector shell such that tabs 280 are received between stand-offs 270.

FIG. 7 is a diagrammatic partially cut-away exploded view, in perspective, of another embodiment of a connector in accordance with the present disclosure, generally indicated by the reference number 10'. To the extent that embodiment 10' includes the features of embodiment 10, descriptions of like features will not be repeated for purposes of brevity. Embodiment 10', while continuing to provide the benefits of embodiment 10, however, includes a second external connection interface 204' that supports a plurality of electrical contacts in the form of pin receptacles 400, several of which are explicitly designated. Thus, connector 10' is configured to mate with a complementary electrical connector. The pin receptacles 400 can be high-speed electrical contacts such as coax, twinax, quadrax and the like, and/or a parallel electrical connector array. Further, flexible electrical circuit assembly 200' can contain electrical filtering circuitry to reduce electromagnetic interference, conducted emissions and/or susceptibility.

FIG. 8 is a diagrammatic exploded view, in perspective, of yet another embodiment of a connector in accordance with the present disclosure, generally indicated by the reference number 10". To the extent that embodiment 10" includes the features of embodiment 10, descriptions of like features will not be repeated for purposes of brevity. Embodiment 10", while continuing to provide the benefits of embodiment 10, however, includes a second external connection interface 204" that supports TOSA 120 and ROSA 124 (not visible), as well as a plurality of electrical contacts in the form of pin receptacles 400, several of which are explicitly designated. Thus, connector 10' can be referred to as a hybrid embodiment that is configured to mate with a complementary connector including, for example, electrical pins and fiber optic cables. While embodiments 10' and 10" utilize a second external connection interface utilizing two connection pads and having an essentially bifurcated configuration leading to middle circuit section 210, it should be appreciated that any suitable number of extensions and associated connection pads can be utilized in any embodiment. For example, in an embodiment, the second external connection interface can use a single connection pad with a single flexible extension leading to the middle circuit section.

It is noted that the hybrid constructions just described of opto-electronic interfaces alongside electrical pins, when coupled with electrical filtering on the electrical pins, can provide for noise-suppression of low-frequency or DC electrical signals on the electrical pins, while passing very high-speed signals on the optical fiber paths. The optical interfaces naturally provide high isolation to and immunity from electrical interference, regardless of the signal bandwidth.

Attention is now directed to FIG. 9 for purposes of describing another embodiment of a flexible circuit assembly in accordance with the present disclosure and generally indicated by the reference number 200'". FIG. 9 is a diagrammatic partially exploded view, in perspective, of the flexible circuit assembly shown in isolation from the remainder of the connector for purposes of illustrating details of its structure. It should be appreciated that assembly 200'" is suitable for use in place of any previous embodiment of the assembly as well as in a wide variety of other embodiments of the panel mount connector of the present disclosure. To the extent that embodiment 200'" includes the features of previously described embodiments, descriptions of like features may not be repeated for purposes of brevity. Embodiment 200'", while continuing to provide the benefits of previously described embodiments, however, includes a first external connection interface 40'" that supports a multi-contact electrical connector 500. In this regard, a complementary or mating connector can be supported by printed circuit board 50 of FIG. 1. In addition to conforming to the physical constraints imposed by rigid interface 40'", suitable connector types are configured for mating/de-mating responsive to linear movement in a direction that is at least generally normal to the surface to which connector 500 is mounted. In the present example, the mounting surface is the outwardly facing major surface of interface 40'''. By way of non-limiting example, the present embodiment illustrates a high-speed parallel array connector that provides 10 contacts per row (i.e., 10 contact pairs) and supports data rates at least as high as 33 Gbps per contact pair. One example of such a connector is the SSH series connector that is produced by SAMTEC. The connector can include features that provide for achieving initial alignment when initially engaging a complementary connector. In some embodiments, guide pins can be provided for this purpose.

Connector 500, for example, can include solder pads and/pins for electrically interfacing the connector to interface 40''' as well as providing physical support. In the present embodiment, connector 500 is provided in a surface mount configuration. Since connector 500 is supported by first external connection interface 40''', it can move independent of connector shell 20 responsive to mating, demating, installation-induced torque and the like in a manner that is consistent with the descriptions which appear above with respect to other embodiments such that connector 500, interface 40''', a mating connector, supporting printed circuit boards and any associated solder connections are isolated from potentially damaging forces. It should be appreciated that the use of connector 500 does not impose any particular constraints on the physical form and/or signal composition of a second external connection interface 204''' at the opposing end of flexible circuit board assembly 200'''. For example, a wide variety of configurations of the second external interface can be used including electrical, optical and hybrid opto-electrical and is not limited to the particular embodiments that have been described herein.

Based on the figures, it should be appreciated that the first and second external connection interfaces can be configured in a highly flexible manner for purposes of suiting a wide variety of different applications in view of the teachings that have been brought to light herein.

The foregoing description of the invention has been presented for purposes of illustration and description. Accordingly, the present application is not intended to be exhaustive or to limit the invention to the precise form or forms disclosed, and other embodiments, modifications and variations may be possible in light of the above teachings wherein those of skill in the art will recognize certain modifications, permutations, additions and sub-combinations thereof.

What is claimed is:

1. A panel mount connector, comprising:

a connector shell assembly configured to be received in an opening that is defined by a panel, the connector shell assembly defining a through passage;

a flexible circuit board supported substantially within the through passage and defining a first external connection interface at one end thereof for external electrical access from one side of the panel when the connector shell assembly is installed therein and defining a second external connection interface at an opposing end of the flexible circuit board for external access from an opposite side of the panel when the connector shell assembly is installed therein with the second external connection interface including at least one of an electrical connection interface for external electrical communication on the opposing side of the panel and an optical connection interface for external optical communication on the opposing side of the panel and at least the first external connection interface is captured by the connector shell assembly and supported by the flexible circuit board for independent movement relative to the connector shell assembly wherein the connector shell assembly includes a main connector shell body defining a first entrance opening from which the first external connection interface is accessed when the flexible circuit board is received in the through passage; and a retainer ring is configured for removably fixed engagement with the main connector shell body at the first entrance opening and the retainer ring is further configured for capturing the first external connection interface for said independent movement.

2. The panel mount connector of claim 1 wherein said connector shell assembly is receivable in said opening subject to a tolerance at least with respect to limiting rotation of the connector shell assembly relative to the panel and wherein said independent movement isolates the first external connection interface from an installation induced rotation of the connector shell assembly relative to the panel at least up to said tolerance by flexing the flexible circuit board with the first external connection interface independently externally affixed for external electrical communication therewith such that the installation induced rotation would otherwise subject the first external connection interface to an installation induced torque.

3. The panel mount connector of claim 1 wherein the connector shell assembly defines a central axis and at least the first external connection interface is supported for said independent movement at least for rotation about said central axis and for movement along the central axis relative to the connector shell assembly by flexing the flexible circuit board.

4. The panel mount connector of claim 1 wherein the flexible circuit board includes a first flex extension that is configured to electrically extend to the first external connection interface and at least a second flex extension to electrically extend to the second external connection interface such that at least the first flex extension and the second flex extension provide for said independent movement.

5. The panel mount connector of claim 1 wherein the connector shell assembly defines a central axis within said through passage and the flexible circuit board includes an elongated length that is folded to pass through the central axis between the first external connection interface and the second external connection interface.

6. The panel mount connector of claim 5 wherein the flexible circuit board is maintained within the through passage by said first external connection interface and said second external connection interface.

7. The panel mount connector of claim 1 wherein said first external connection interface supports a plurality of electrical connection pins that extend outwardly from the through passage of the connector shell assembly such that the pins are fixedly receivable by a complementary external electrical connection for external electrical communication therewith and for isolation, at least to a limited extent, from movement of the connector shell assembly relative to the complementary external electrical connection by said independent movement.

8. The panel mount connector of claim 1 wherein said first external connection interface supports a multi-contact electrical connector that faces outwardly from the through passage of the connector shell assembly and includes a plurality of contact pairs each supporting at least 33 Gbps such that the multi-contact electrical connector is receivable by a complementary multi-contact electrical connector for external electrical communication therewith and for isolation, at least to a limited extent, from movement of the connector shell assembly relative to the complementary external electrical connection by said independent movement.

9. The panel mount connector of claim 1 wherein the retainer ring is configured to cooperate with the main connector shell body for a snap fit to resiliently attach the retainer ring to the main connector shell body.

10. The panel mount connector of claim 1 wherein the retainer ring includes an annular snap ring portion for removably attaching the retainer ring to the main connector shell body.

11. The panel mount connector of claim 10 wherein the annular snap ring portion includes an outer catch that projects outwardly for engaging a peripheral edge that is defined by the main connector shell body.

12. The panel mount connector of claim 10 wherein the retainer ring defines a central axis and the retainer ring includes a plurality of standoff posts, each standoff post extending from the annular snap ring portion to a free end in a direction that is outward from the first entrance opening, when the retainer ring is attached to the main connector shell body, and at least generally aligned with the central axis, each standoff post terminating in a standoff surface that is defined at the free end for biasing against an opposing external interface surface.

13. The panel mount connector of claim 1 wherein said flexible circuit board includes a middle circuit section having a rigid substrate from which a first flexible extension and a second flexible extension extend to the first external connection interface and the second external connection interface, respectively, and the main body connector shell defines an annular shoulder for receiving the middle circuit section thereagainst after passing through the first entrance opening and the main body connector shell further defines an annular groove for receiving a resilient snap ring to capture the middle circuit section between the annular shoulder and the resilient snap ring.

14. A method for producing a panel mount connector, said method comprising:

configuring a connector shell assembly to be received in an opening that is defined by a panel and such that the connector shell assembly defines a through passage; and supporting a flexible circuit board substantially within the through passage and defining a first external connection interface at one end thereof for external electrical access from one side of the panel when installed in the connector shell assembly and defining a second external connection interface at an opposing end of the flexible circuit board for external access from an opposite side of the panel when installed in the connector shell assembly with the second external connection interface including at least one of an electrical connection interface for external electrical communication on the opposing side of the panel and an optical connection interface for external optical communication on the opposing side of the panel;

capturing at least the first external connection interface with the connector shell assembly and with the first external connection interface supported for independent movement by the flexible circuit board relative to the connector shell assembly; and removably engaging a retainer ring with the main connector shell body at the first entrance opening and the retainer ring is further configured for capturing the first external connection interface for said independent movement.

* * * * *